United States Patent [19]

Auretta

[11] 4,284,092

[45] Aug. 18, 1981

[54] HAIRPIECE ATTACHING STRUCTURE AND METHOD

[76] Inventor: Frank Auretta, 55 Miller Rd., South Windsor, Conn. 06074

[21] Appl. No.: 118,187

[22] Filed: Feb. 4, 1980

[51] Int. Cl.[3] ..... A41G 3/00

[52] U.S. Cl. ..... 132/53

[58] Field of Search ..... 132/53, 54, 5; 3/1

[56] References Cited

U.S. PATENT DOCUMENTS

| | | | |
|---|---|---|---|
| 1,638,016 | 8/1927 | Oppenheim | 132/53 |
| 3,608,095 | 3/1970 | Barry | 3/1 |
| 4,054,954 | 10/1977 | Nakayama | 3/1 |
| 4,092,739 | 6/1978 | Clemens | 3/1 |

*Primary Examiner*—G. E. McNeill

*Attorney, Agent, or Firm*—Hayes & Reinsmith

[57] ABSTRACT

A compression coil spring is attached to a person's scalp along the boundary between a bald spot and growing hair by spreading apart the coils of the spring so that the hairs are gripped between adjacent coils when the spring is released. After the spring is thus installed, a thin plastic tube having a slot extending along its length is fitted over the spring. The hairpiece is then attached to the scalp by means of thread or hooks. Integral tabs may be cut in the surface of the plastic tube to provide a means for anchoring the thread.

9 Claims, 9 Drawing Figures

HAIRPIECE ATTACHING STRUCTURE AND METHOD

BACKGROUND OF THE INVENTION

1. Field of the Invention

The invention relates generally to the field of hairpieces and, more particularly, to a means and method for attaching a hairpiece to a person's head.

2. Description of the Prior Art

U.S. Pat. No. 1,627,469 discloses a hairpiece attaching means in the form of an elongated coil spring having loops at the opposite ends thereof to provide means for attaching a hairpiece thereto. The spring is pressed against the person's head so that natural hairs are forced between adjacent coils which grip the hairs. U.S. Pat. No. 1,638,016 also discloses a hairpiece attaching device in a form of a coil spring having loops at the opposite ends thereof to provide means for attaching a hairpiece.

Both of these prior art hairpieces are in the form of artificial hairdresses for attaching long artificial hair to bobbed or short hair and are not particularly suitable for the attachment of a hairpiece to a man's head for covering a bald spot on the top of the scalp, for example.

SUMMARY OF THE INVENTION

Thus, the broad object of this invention is to provide an improved means and method for attaching a hairpiece to a person's head.

A more specific object of the invention is to provide such a means and method for attaching a hairpiece of the type which is designed to cover a bald spot on the top of a person's scalp.

The attaching means may be briefly summarized as elongated compression coil spring and a flexible plastic tube having a slot therein which permits the tube to be fitted over the coil spring after the spring is installed on a person's head. The plastic tube then provides a base to which a hairpiece may be suitably attached by sewing a thread around the tube and to the hairpiece. The plastic tube may have integral tabs cut therein to provide means for anchoring the thread. The hairpiece may also be attached to the plastic tube by hooks which are fixed to the hairpiece.

Thus, the use of the spring and tube assembly of this invention permits a hairpiece to be attached to a person's natural hair in a manner such that the hairpiece cannot easily be accidently removed, and provides a sense of permanency to the wearer.

DETAILED DESCRIPTION OF THE PREFERRED EMBODIMENTS

Figure 1:
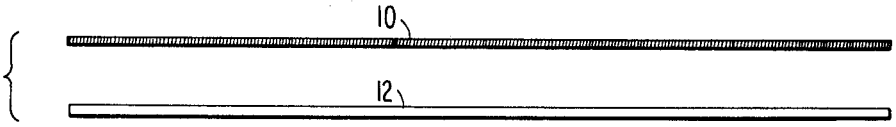
FIG. 1 illustrates the coil spring and slotted plastic tube which form the hairpiece attachment device of the invention.
Figure 2:
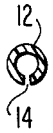
FIG. 2 is a cross sectional view of the plastic tube of FIG. 1 and shows the longitudinal slot in the tube.

As shown in FIGS. 1 and 2, the hairpiece attachment device consists of elongated coil spring 10 which is normally under compression and an elongated nylon plastic flexible tube 12 having a slot 14 which extends parallel to the axis of the tube from one end to the other. Typically, the compression spring 10 is approximately fourteen inches long and is of circular cross section having a diameter of approximately 0.064 inch. The nylon tube 12 is of approximately the same length is also of circular cross section, and, in its normal unstressed state has an inside diameter which is slightly less than the diameter of the spring 10 so that the tube 12 firmly grips the spring 10 when the tube is fitted over the spring as will be described in more detail below. The slot 14 in the flexible tube 12 has a width of approximately 0.025 inch and permits the tube walls forming the opposite faces of the slot to be spread apart so that the tube can be fitted over the spring 10.

There will now be described the steps involved in installing the hairpiece attachment device on the head of a man having a bald area on the top front of his scalp.

First, the operator places the hairpiece 15 on the exact area of the man's head where the hairpiece is to be worn. The front of the hairpiece is taped to the man's head so that the hairpiece will not move. The operator then pins the hairpiece hair up so that the entire edge of the base 16 of the hairpiece is exposed. Pins, such as pin 18, are used for this purpose.

The operator then forms a part 20 adjacent the exposed edge of the hairpiece base and extending from one temple to the other. The man's natural hair 22 above the part 20 is pinned to the hairpiece hair by means of pins 24 and 26, for example.

The hairpiece and man's head are now ready for installation of the coil spring 10 in the part 20.

Figure 3:
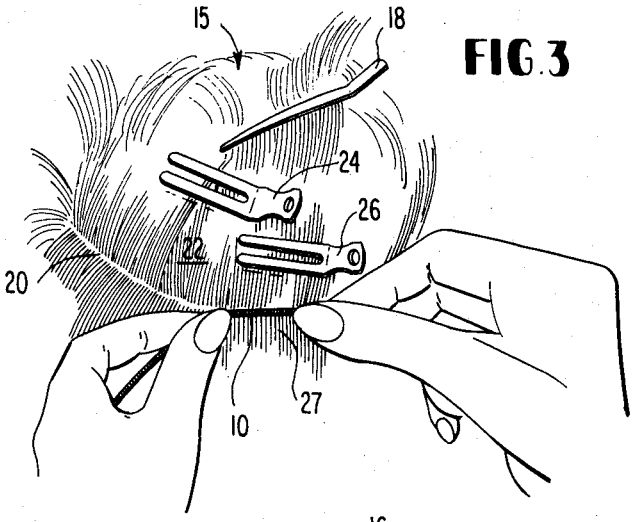
FIGS. 3, 4 and 5 illustrate some of the basic steps of the method of installing the hairpiece attachment device to a person's head.

As shown in FIG. 3, the operator grips the spring at the center thereof at two points about one inch apart with the index finger and thumb of both hands. The spring is then installed by pulling the hands apart to expand the spring and separate the spring coils. The expanded section of the spring is inserted into the natural hair 27 just above the roots thereof at the bottom of part 20. Then, the spring is released so that the spring returns to its normal state whereby the hairs are firmly gripped between adjacent coils of the spring.

Figure 4:
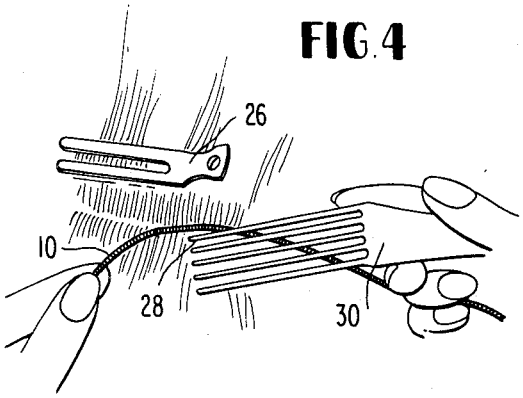

Then, as shown in FIG. 4, the same section of the spring is again expanded, using the thumb and index finger of one hand and two other fingers of the other hand, and the operator uses the tine 28 of a hair pick 30 to pull a fine layer of the natural hair above the part 20 downwardly and into the bottom of the spring coils. The spring is then slowly released, and the first section of hair is now installed in the spring.

The above steps are repeated for other one inch sections of the spring, working outwardly from the center of the spring to one temple and then to the other temple, until the spring covers the entire part 20. Even though there will probably be an excess length of spring at each temple, the spring is not trimmed at this time.

Figure 5:
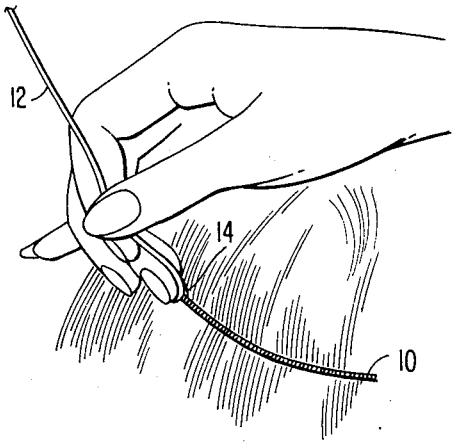

As shown in FIG. 5, the operator now installs the slotted nylon tube or cover 12 over the installed spring 10 by placing the slot 14 over the spring and pressing downwardly against the man's head. The installation is facilitated by spreading the slot 14 open at one end of the tube so that the tube snaps over the spring. The operator starts installing the tube 12 at about one quarter inch beyond one temple. As shown in FIG. 5, the tube 12 is bent backward on itself so the operator can see the slot 14. The tube 12 is then installed along the length of the spring to the opposite temple merely by pressing firmly down on the tube against the man's head. When the tube or cover 12 is properly installed, it will be firmly locked along its entire length on the spring 10. The excess length of spring and tube protruding forwardly from each temple is then cut off. The pins 24 and 26 are now removed, and the patient's natural hair 22 combed downwardly over the installed hairpiece attachment device. In most cases, the device will be completely hidden by the person's hair.

Figure 6:
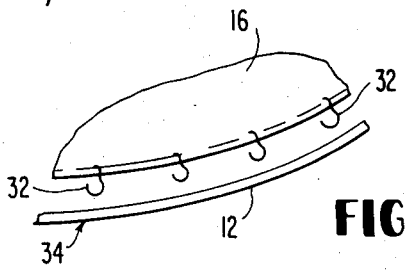
FIGS. 6 and 7 illustrate two different ways for attaching a hairpiece to a spring and tube assembly device already installed on a person's head.

As shown in FIG. 6, the hairpiece 15 may be secured by hooks 32 to the installed hairpiece attachment device 34 consisting of the plastic tube 12 fitted over the spring 10. One end of each hook 32 is fixed to the base 16 of the hairpiece, and the other end is hooked over the attachment device 34, thereby firmly securing the hairpiece to the attachment device.

Figure 7:
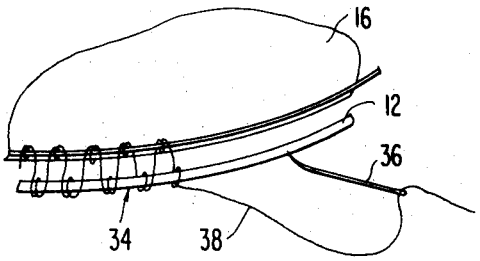

FIG. 7 illustrates another method of attaching the hairpiece to the attachment device 34. Here, the hairpiece is sewn to the attachment device by use of a needle 36 to loop thread 38 through the hairpiece base 16 and around the attachment device 34, and then to pull the thread tight so that the edge of the base 16 abuts the attachment device 34.

Figure 8:
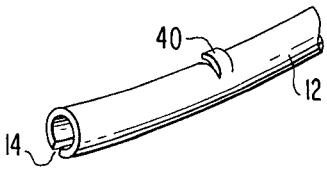
FIG. 8 is a partial perspective view illustrating a second embodiment of the structure of the plastic tube.
Figure 9:
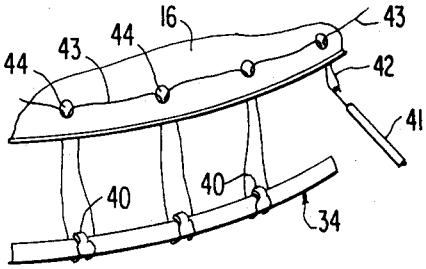
FIG. 9 illustrates the manner in which a hairpiece is sewn to an attachment device incorporating the second embodiment of the plastic tube.

FIGS. 8 and 9 illustrate a modified form of the flexible nylon tube 12. Here, a plurality of spaced tabs 40 are cut in the surface of the tube 12 in order to provide a means for anchoring a thread used to secure the hairpiece to the attachment device 34. In this embodiment of the hair attachment device, and as shown in FIG. 9, the hairpiece is attached to the attachment device 34 by using a hook 41 to pull a bight 42 of a thread 43 through each of a plurality of openings 44 in the hairpiece base 16, then under the attachment device 34 and over the raised end of a tab 40 which then securely anchors the thread to the attachment device 34 when the thread is tightened by pulling the opposite free ends thereof in opposite directions to draw the hairpiece base 16 against the attachment device 34.

After several weeks, the attachment device 34 will become loose because of the growth of the natural hair to which the spring 10 is secured. At this time, the operator merely removes the plastic tube 12 from the spring 10, holds the hair to which the spring is attached, and presses the spring down against the scalp one inch at a time along the entire length of the spring. After the entire spring is again tightly secured against the scalp, the tube or cover 12 is again fitted over the spring as described above.

Thus, there has been described above an improved hairpiece attachment device and method for attaching a hairpiece to the device. The installation of a hairpiece by means of the improved hair attachment device and using the methods described above produces a more secure attachment, lasts longer, and is simpler than the conventional hairweave or fusion methods. With little experience, an operator can install the improved attachment device in about fifteen minutes or less. No special skills are required, and anyone who has cut and installed a hairpiece can install the improved hair attachment device.

I claim:

1. A hairpiece attachment device for attaching a hairpiece to the scalp of a person and comprising:

elongated coil spring means for gripping between the coils thereof the natural hair growing on a person's head to secure said spring means to the head; and elongated flexible tubular means having a longitudinal slot extending from one end thereof to the other and adapted to fit over said coil spring means along the length thereof to provide a surface for securing a hairpiece.

2. The device as defined in claim 1 further comprising thread-anchoring means formed in the surface of said tubular means for anchoring thread used to secure the hairpiece to said tubular means.

3. The device as defined in claim 2 wherein said anchoring means comprises a plurality of integral tabs formed in the surface of said tubular means and spaced along the length thereof.

4. The device defined in claim 3 wherein said coil spring means and said tubular means are circular in cross-section, and wherein said tabs are formed in the surface opposite said longitudinal slot.

5. A method of attaching a hairpiece to the scalp of a person and comprising the steps of:

securing a compression coil spring to a person's scalp by applying tension to the spring to spread apart the coils of the spring in a section thereof to receive between adjacent coils the natural hairs growing in the person's scalp;

releasing the tension from the spring so that the hairs are firmly gripped between the adjacent coils;

fitting over the length of the secured spring a flexible tube having a longitudinal slot therein; and securing a hairpiece to the secured spring by attaching the hairpiece to the flexible tube fitted over the coil spring.

6. The method defined in claim 5 wherein said securing step comprises hooking the hairpiece to the secured spring by means of a plurality of hooks fixed to the hairpiece.

7. The method as defined in claim 5 wherein said securing step comprises sewing the hairpiece to the flexible tube.

8. The method defined in claim 5 wherein said securing step comprises cutting tabs in the surface of the flexible tube prior to fitting the tube over the spring, pulling bights of a thread through holes in the hairpiece, passing the bights of thread under the secured spring, back over the surface of the fitted tube and over the free ends of the tabs, and then pulling the free ends of the thread apart to draw the hairpiece into engagement with the fitted tube, thereby securing the hairpiece to the person's scalp.

9. The method defined in claim 5 wherein said securing step comprises, first, placing the hairpiece on the area of the head to be covered thereby, forming a part in the natural hair adjacent the area covered by the hairpiece, pinning up the natural hair above the part to the hairpiece, placing the coil spring in the part, inserting between the spring's coils the hairs below the part, and then pulling the pinned-up hairs downwardly between the coils of the spring after the tube is fitted over the spring.

* * * * *